United States Patent [19]

Farrington et al.

[11] Patent Number: 4,626,832

[45] Date of Patent: Dec. 2, 1986

[54] SOLAR SYSTEM FAULT DETECTION

[75] Inventors: Robert B. Farrington, Wheatridge; James C. Pruett, Jr., Lakewood, both of Colo.

[73] Assignee: The United States of America as represented by the United States Department of Energy, Washington, D.C.

[21] Appl. No.: 609,686

[22] Filed: May 14, 1984

[51] Int. Cl.[4] ..... G08B 19/00

[52] U.S. Cl. ..... 340/522; 340/500; 340/501; 340/521; 340/525

[58] Field of Search ..... 340/522, 521, 525, 500, 340/501, 506, 679, 687, 635; 323/906; 237/1 R, 2 R; 126/419, 422; 165/18, 485, 11.1; 203/DIG. 1, 1; 62/235.1

[56] References Cited

U.S. PATENT DOCUMENTS

| | | | |
|---|---|---|---|
| 3,855,536 | 12/1974 | Neuner | 340/522 |
| 4,020,488 | 4/1977 | Martin et al. | 340/522 |
| 4,195,286 | 3/1980 | Galvin | 340/522 |
| 4,387,368 | 6/1983 | Day, III et al. | 340/521 |

FOREIGN PATENT DOCUMENTS

| | | | |
|---|---|---|---|
| 1234472 | 6/1971 | United Kingdom | 340/522 |

*Primary Examiner*—Donnie L. Crosland

*Attorney, Agent, or Firm*—Kenneth L. Richardson; John M. Albrecht; Judson R. Hightower

[57] ABSTRACT

A fault detecting apparatus and method are provided for use with an active solar system. The apparatus provides an indication as to whether one or more predetermined faults have occurred in the solar system. The apparatus includes a plurality of sensors, each sensor being used in determining whether a predetermined condition is present. The outputs of the sensors are combined in a pre-established manner in accordance with the kind of predetermined faults to be detected. Indicators communicate with the outputs generated by combining the sensor outputs to give the user of the solar system and the apparatus an indication as to whether a predetermined fault has occurred. Upon detection and indication of any predetermined fault, the user can take appropriate corrective action so that the overall reliability and efficiency of the active solar system are increased.

31 Claims, 2 Drawing Figures

SOLAR SYSTEM FAULT DETECTION

CONTRACTUAL ORIGIN OF THE INVENTION

The U.S. Government has rights in this invention under Contract No. DE-AC02-83CH10093 between the U.S. Department of Energy and the Solar Energy Research Institute, a Division of Midwest Research Institute.

BACKGROUND OF THE INVENTION

1. Field of the Invention

The present invention relates to a fault-detecting apparatus and method used in connection with an active solar system.

2. Description of the Prior Art

In active solar systems, including water systems and antifreeze systems, a number of faults can occur relating to the operation of the system. Such malfunctions include actual system failures which can be defined as failure of the solar energy-absorbing fluid (including but not limited to water and antifreezes) to circulate in the system, and failure to protect portions of the system and/or the solar fluid from freezing. Additionally, other failures can be defined relating to improper operation of the system wherein such operation leads to a loss of collected energy or are indicative of potential serious system problems including: the failure of the system to shut down when appropriate, e.g., sunlight not being available; failure to protect the storage tank of the system from overheating; failure due to excessive pipe corrosion; and failure due to pipe scaling, which is primarily the result of the high mineral content of water.

It would be advantageous to know when such failures occur so that the user or owner of the solar system is alerted to potentially expensive failures and is informed when the system is not operating properly. Such fault detection in an active solar system, such as a solar domestic hot water system, is particularly important because a conventional domestic hot water system normally is used as a backup or auxiliary system to the solar domestic hot water system. As a result, if the solar domestic hot water system fails, the user may only be minimally aware, if at all, of such a failure because the auxiliary system will continue to provide the necessary hot water.

To alleviate this serious deficiency associated with conventional active solar systems, such as the solar domestic hot water system, the present invention utilizes a fault detection system wherein the user is made aware of predetermined failures which can occur during the operation of the active solar system, and in particular the specific identity of the failure which has occurred. Based on this information, the user can take appropriate corrective action immediately thereby minimizing expensive solar system failures and enhancing the efficiency of the operation of the system. In contrast to conventional systems, as previously alluded to above, the user is made aware of the predetermined faults or failures even when a conventional hot water system is used as a back up system, and the hot water is still being provided to the user. In addition, because the present invention requires a manual resetting to remove a fault indication, even after a fault no longer exists, an indication is given to the user that a fault had occurred some time prior, as will be more fully explained hereinafter.

To continue, conventional control systems have been developed which sense predetermined conditions associated with a solar system to provide necessary controls in the operation thereof. Unfortunately, such control systems normally do not provide the desired capability of detecting the predetermined faults which can occur in an active solar system. The present invention, however, does achieve these desired results by monitoring predetermined conditions and making a determination as to whether predetermined faults have occurred. Moreover, it should be noted that the present invention does not even disclose or include a control system whereby control of the active solar system is effected. Instead, as just mentioned, it is directed to alerting the owner or user of the system of the predetermined failures. Because the present invention is not concerned with controlling the operation of the active solar system, the complexity thereof is reduced advantageously over that normally found in conventional solar system controllers.

Against the foregoing background, it is therefore a general object of the present invention to provide a fault-detecting apparatus for applications in active solar systems which advantageously alerts the user thereof to the occurrence of predetermined solar system failures and the specific identities thereof.

It is another general object to provide a low-cost, substantially efficient, simplified, fault-detection system for active solar system applications.

It is a more specific object to provide a fault-detecting apparatus which can be used with either water or anitfreeze-type active solar systems.

It is still another specific object to provide a fault detecting system for active solar system applications which is enabled to indicate whether a number of predetermined failures associated with the active solar system have occurred, i.e., failure of the fluid to circulate in the system, failure of the system to shut down when predetermined conditions are present, failure to protect the collectors or pipes from freezing, failure to prevent overheating of the tank, failure due to excessive corrosion of pipe, and failure due to excessive scaling of pipe.

It is yet another specific object to provide a fault detecting apparatus for active solar system applications having a logic circuit which is enabled to give a visual indication as to whether or not predetermined faults associated with the system have occurred.

It is yet and still another specific object to provide a fault detecting system for active solar system applications which includes a means for manually resetting a fault indication to effect its removal.

SUMMARY OF THE INVENTION

To the accomplishment of the foregoing objects and advantages, the present invention in brief summary comprises a fault-detecting apparatus operatively associated with an active solar system. The fault-detecting apparatus can be used with either water or antifreeze systems. The apparatus detects and indicates to the user whether or not predetermined faults associated with the operation of the solar system have occurred. As a result of the indication of any predetermined faults, the system user can take the appropriate action using the knowledge gained relating to which of a plurality of predetermined faults have occurred.

The apparatus of the present invention includes a number of sensors in operative association with an active solar system, such as a solar domestic hot water system. The sensors are used to detect a number of predetermined conditions associated with the hardware of the system, including solar collectors, pipes, and a tank for receiving the solar fluid. These predetermined conditions relate to the temperature of the solar collectors, the temperature of the tank, whether sunlight is present or not, whether fluid is moving in collectors or pipe, whether fluid is present in the solar collectors or pipe, the temperature of the pipes and collectors carrying the fluid, and the amount of corrosion and scaling present in the pipes.

The apparatus further includes a logic circuit for combining the outputs of the sensors in a desired manner so that the outputs of the logic circuit provide signal states indicative of whether one or more predetermined faults have occurred. Each of the output signals from the logic circuit is applied to an appropriate one of a plurality of indicators whereby a light is lit indicating whether or not a predetermined fault has occurred. From these visual indications, the user is informed as to whether a number of predetermined failures have occurred including failure of the fluid to circulate in the system, failure of the system to shut down when predetermined conditions are present, failure to protect the collectors or pipes from freezing, failure to prevent overheating of the tank, failure due to excessive corrosion of pipe, and failure due to excessive scaling of pipe. Related to the operation of the indicators, flip-flops are used so that, when a fault occurs, a manual resetting is required to remove the fault indication.

BRIEF DESCRIPTION OF THE DRAWINGS

The foregoing and still other objects and advantages of the present invention will be made more apparent from the following detailed explanation of the preferred embodiments of the invention in connection with the accompanying drawings wherein.

DETAILED EXPLANATION OF THE PREFERRED EMBODIMENTS OF THE INVENTION

Figure 1:
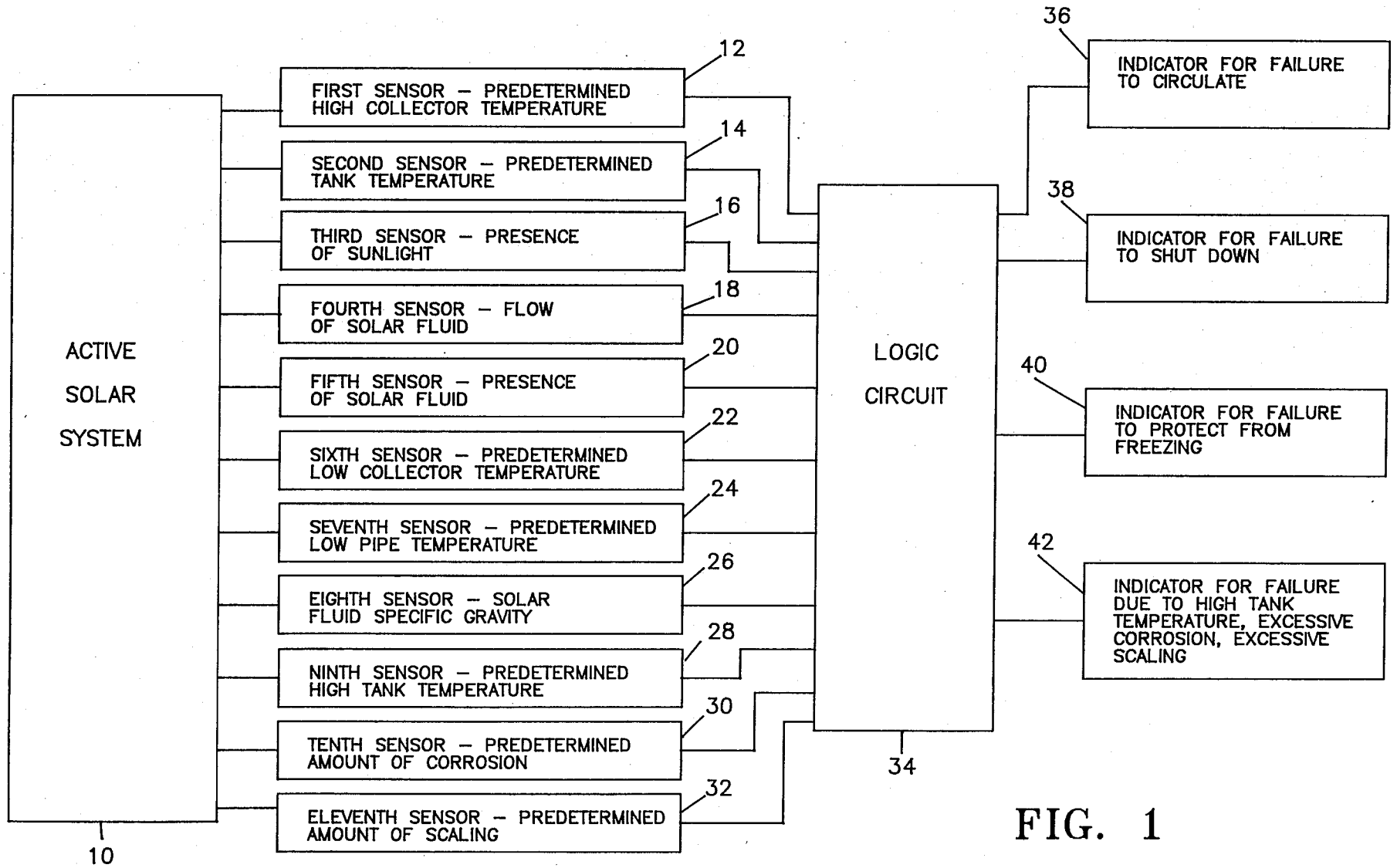
FIG. 1 is a block diagram illustrating the present invention.

In accordance with the present invention, and referring to FIG. 1, a fault-detecting apparatus is provided for detecting predetermined faults or failures in connection with the operation of an active solar system 10, such as a domestic hot water system. The invention uses sensed, predetermined conditions, and combines them in a predetermined manner to provide an indication as to whether one or more predetermined failures have occurred.

The active solar system 10 is a well-known or conventional system for using solar energy to heat fluid, e.g., water or antifreeze, and the present invention can be used with both water and antifreeze systems. With respect to water systems, the apparatus of the present invention can be used with each of such available solar systems conventionally identified as drainback, draindown (drainout), and recirculation systems.

The active solar system 10 typically includes one or more solar collectors and one or more pipes for carrying solar fluid to be heated by solar energy, and a tank for receiving solar fluid. At least some of the pipe is used to interconnect the solar collectors and the tank.

In sensing the predetermined conditions, a number of sensors 12–32 are employed. A first sensor 12 is attached to a solar collector and is used to monitor for a predetermined high collector temperature. When this predetermined temperature is reached or exceeded, the first sensor 12 outputs a signal indicating that this predetermined condition has occurred. In one embodiment, the first sensor 12 is a temperature snap switch. A sensor 14 is attached to the tank and is used to monitor for the presence of a tank temperature which is equal to or below a predetermined temperature. When such a condition occurs or is present, the second sensor 14 outputs a signal indicating the existence of this predetermined condition. Like the first sensor 12, the second sensor 14 is also preferably a temperature snap switch. A third sensor 16 is used to monitor for the presence of sunlight, and thus can be placed nearly anywhere in the system that receives adequate sunlight to allow proper operation. When sunlight is present, the output of the third sensor 16 is a signal indicating that sunlight is present. In detecting the presence of sunlight, a photoelectric cell or photodiode can be used to detect the presence or absence of irradiance. The first, second, and third sensors 12, 14, 16, respectively, are each used in both antifreeze and water systems.

In antifreeze systems, as well as water draindown and recirculation systems, a fourth sensor 18 is used to monitor for flow of the solar fluid in the solar system. The output signal from the sensor 18 therefore provides an indication as to whether solar fluid is moving in the system. In one embodiment, the fourth sensor 18 is a flow switch which is provided in the pipe or collector to detect the flow of solar fluid therethrough.

In draindown and drainback systems, a fifth sensor 20 is employed for monitoring the presence of water. The output signal from the fifth sensor 20 provides an indication therefore as to whether water is present in the collector or pipe, at which pipe or collector the sensor 20 is normally positioned. In one embodiment, a liquid float switch acts as the fifth sensor 20.

Sixth and seventh sensors 22, 24, respectively, are used in water systems for monitoring the temperature of the collector and the temperature of pipe through which the water flows. When the temperature of the collector or the pipe is equal to or below a predetermined temperature, the output of the appropriate sensor 22 or 24 is a signal indicating that such a predetermined condition exists. In one embodiment, the sixth and seventh sensors 22, 24 are temperature snap switches. The sensors 22, 24 are normally positioned at the collector and the pipe, respectively.

An eighth sensor 26 is used to monitor for low fluid specific gravity and is provided in antifreeze systems. In one embodiment, the eighth sensor 26 is a hydrometer switch positioned in the pipe for monitoring the specific gravity or density of the solar fluid so that, as the freezing point of the antifreeze rises, the specific gravity thereof drops. When the specific gravity is equal to or falls below a predetermined value, the eighth sensor 24 outputs a signal indicating that this predetermined condition has occurred. In one embodiment, the eighth sensor 26 replaces the sixth and/or seventh sensors 22, 24 or both since such sensors 22, 24 are not needed in an antifreeze solar system.

A ninth sensor 28 is used to monitor for a predetermined high temperature of the tank at which the sensor 28 is normally located. When this predetermined temperature is reached or exceeded, the ninth sensor 28 outputs a signal indicating that the predetermined high tank temperature exists. In one embodiment, the ninth sensor 28 is a temperature snap switch.

A tenth sensor 30 is provided or suspended in the solar fluid to monitor for corrosion of the pipe. In one possible embodiment, the tenth sensor 30 is a thin metal foil fuse which triggers a change in state if fluid penetrates the foil. Another possible embodiment includes a metal wire wherein a change in resistance is detected, as the cross-sectional area of the wire decreases due to corrosion.

An eleventh sensor 32 is provided or suspended in the solar fluid for use in monitoring the presence of scaling in the pipe. This detecting capability is expected to only be used in water systems because scaling is primarily due to high mineral content water. In one possible embodiment, the eleventh sensor 32 includes a self-heating device that overheats due to the insulating nature of the scaling.

The outputs from each of the sensors 12–32 are applied to a logic circuit 34. The logic circuit 34 combines outputs of the sensors 12–32 in a predetermined manner so that the outputs from the logic circuit 34 are indicative of whether one or more predetermined faults are present or existing in the system. The outputs of the logic circuit 34 communicate with a number of indicators 36, 38, 40, 42 that visually display the presence or absence of predetermined faults to the user or owner of the system.

As FIG. 1 shows, indicator 36 is provided to indicate whether there is a failure of the solar fluid to circulate in the system. This predetermined fault is indicated when both first sensor 12 indicates that a predetermined high collector temperature is reached or exceeded and when the second sensor 14 indicates that the tank temperature is equal to or below a predetermined temperature. The existence of both conditions is required before a failure is found because many controllers used in active solar systems intentionally stop pump operation and thereby increase the temperature of the collector when a predetermined high tank temperature is sensed in order to prevent high tank temperature. Consequently, the present invention requires that both these conditions be met before the failure to circulate fault is indicated.

In an antifreeze system using flat-plate collectors, the first sensor or temperature snap switch 12 should actuate at about 120° C. As a general rule, the temperature snap switch 12 should actuate below the pre-established temperature which actuates the pressure/temperature relief valve in the system.

In water systems, the temperature/pressure relief valve actuates at 125 psig and 210° F. Accordingly, the first sensor or temperature snap switch 12 should therefore actuate below 210° F. (98° C.).

The indicator 38 is provided to indicate whether or not there has been a failure of the solar system 10 to shut down under appropriate circumstances. This predetermined failure occurs when certain conditions exist, depending upon the type of system being used. In the case of antifreeze systems water draindown systems, and water recirculation systems, this failure is present when no sunlight is present while, at the same time, the flow of solar fluid is detected. In the case of water drainback systems, this failure exists when no sunlight is detected while, at the same time, the presence of water is sensed in the pipe or collector. These different combinations of conditions indicate that the pump has not shut down or deactivated after sunset. This incorrect mode of operation leads to loss of collector energy and reduces system effectiveness.

The indicator 40 is provided to indicate whether there has been a failure to protect the system from freezing. In antifreeze systems, the change of state of the eighth sensor or hydrometer switch 26 triggers an indication that such a failure is present.

In water systems, this failure exists when certain combinations of predetermined conditions are present. In drainback and draindown systems, when the fifth sensor 20 indicates that water is present and the temperature of the collector is equal to or less than a predetermined temperature or the temperature of the pipe is equal to or less than a predetermined temperature, an indication is provided that the water system has failed in being protected from freezing.

With regard to recirculation systems, since recirculation systems are designed to prevent the collector and pipe from reaching low temperatures during freezing conditions, the failure exists when the temperature of the collector is equal to or less than a predetermined temperature or when the pipe temperature is equal to or less than a predetermined temperature.

Both a predetermined low collector temperature and a predetermined low pipe temperature are sensed because the temperature of one of them may be below freezing while the other is not. That is, a collector can freeze from radiant cooling on clear nights with the ambient temperature above freezing so that the pipe does not freeze, while the pipe can freeze on cold winter days having below freezing temperatures and marginal solar irradiance, which will not initiate pump operation but will warm the collector to temperatures above freezing. Additionally, to prevent an unwanted indication of a failure relating to freezing, it may be desirable to have a built-in time delay to prevent a false indication of freezing when the collector is sufficiently warm to warrant pump operation but the pipe is still cold from the previous night.

The indicator 42 is provided to indicate that a failure has occurred due to the detection of one or more of three predetermined conditions. When the ninth sensor 28 detects that a predetermined high tank temperature has been reached or exceeded, an indication of a failure is provided by the indicator 42. Likewise, when a predetermined magnitude of corrosion exists in the pipe causing a change of state in the tenth sensor 30, a failure indication is provided by the indicator 42. Similarly, when a predetermined magnitude of scaling exists in the pipe causing a change of state in the eleventh sensor 32, this failure indication will be provided by the indicator 42. It is readily understood that each of the sensors 28, 30, 32 could communicate with a separate indicator so that the user or owner is made aware of which of the three failures is present.

Figure 2:
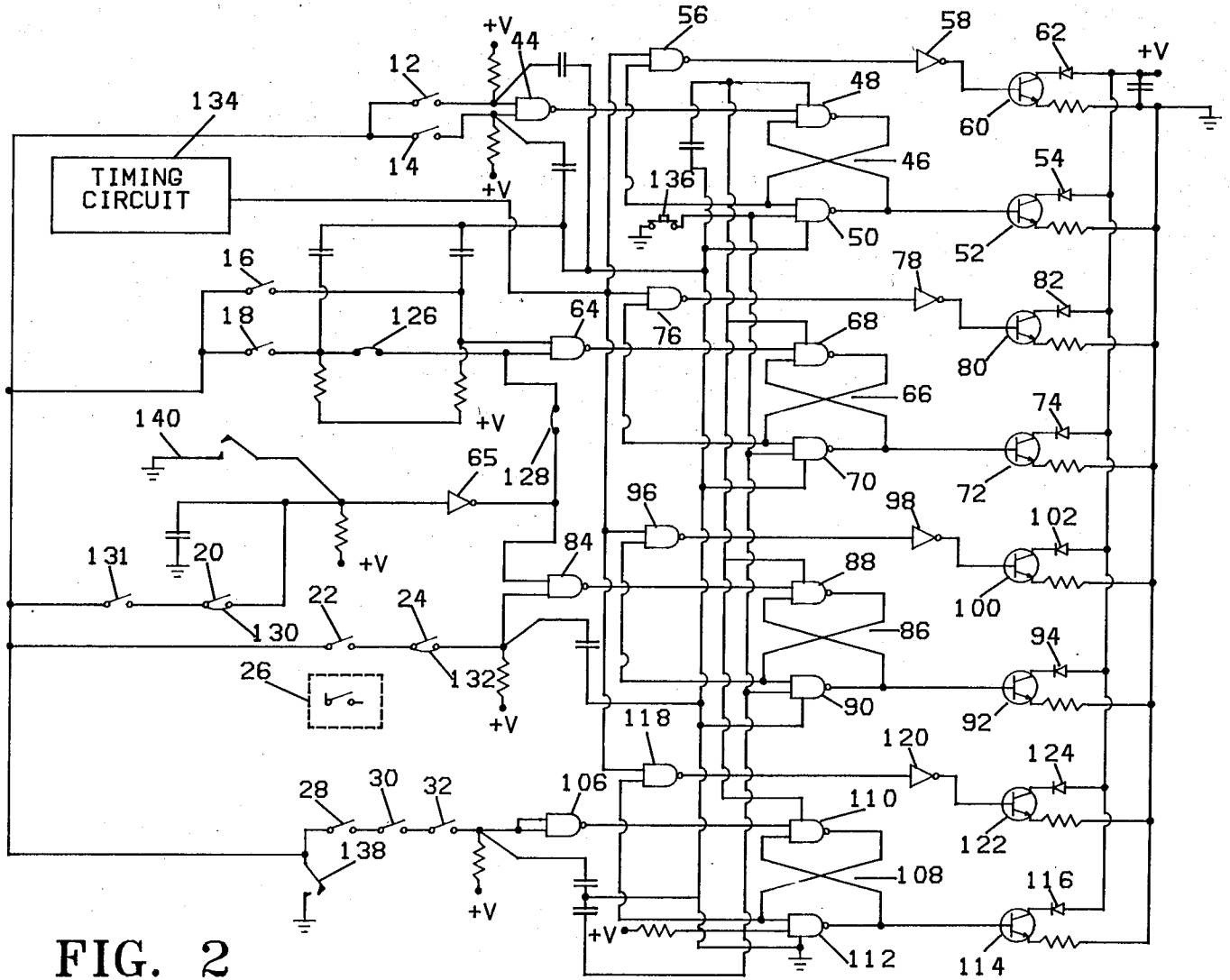
FIG. 2 is a schematic of the sensors, logic circuit, and indicators of one embodiment of the present invention.

Referring now to FIG. 2, the logic circuit 34, as well as the indicators 36–42, are shown in more detail. In addition, the sensors 12–32 are represented as switches which communicate with a number of logic gates. Specifically, the outputs of the first sensor 12 and the second sensor 14 are inputted to NAND gate 44. The output of the NAND gate 44 is sent to a flip-flop 46. The flip-flop 46 includes NAND gate 48 and NAND gate 50. The output of the NAND gate 50 is applied to the base of a transistor switch 52. The transistor switch 52 controls the turning on and turning off of the LED 54. When the transistor 52 is turned on, a green indication is provided. The output of the NAND gate 48 of the flip-flop 46 is applied to the NAND gate 56. The output of the NAND gate 56 is sent to an Inverter 58, the output of which is sent to the base of transistor switch 60. The transistor switch 60 controls the turning on and turning off of the LED 62. When the transistor switch 60 is turned on, the LED 62 provides a red indication.

The output of the third sensor 16 is applied to the NAND gate 64. The output of the fourth sensor 18 is also applied to the NAND gate 64. The fifth sensor 20 also communicates with the NAND gate 64, the output thereof being first inverted by the Inverter 65. The output of the NAND gate 64 is sent to a flip-flop 66, which includes NAND gates 68, 70. The output of the NAND gate 70 is sent to the base of the transistor switch 72, which controls the turning on and turning off of the LED 74. When the transistor switch 72 is turned on, the LED 74 provides a green indication.

The output of the NAND gate 68 is inputted to the NAND gate 76. The output of the NAND gate 76 communicates with an Inverter 78, and the transistor switch 80 is responsive to the output of the Inverter 78. The transistor switch 80 controls the turning on and turning off of the LED 82. When the transistor 80 is turned on, the LED 82 provides a red indication.

The output of the fifth sensor 20 is electrically connected to the input of the Inverter 65 which is connected to the input of the NAND gate 84. Also being inputted to the NAND gate 84 are the outputs from the sixth and seventh sensors 22, 24. In the case of an antifreeze system, the eighth sensor 26 replaces one or both sensors 22, 24.

The output of the NAND gate 84 is sent to the flip-flop 86, which includes NAND gates 88, 90. The output of the NAND gate 90 is applied to the base of the transistor switch 92, which controls the turning on and turning off of the LED 94. When the transistor 92 is turned on, the LED 94 provides a green indication. The output of the NAND gate 88 of the flip-flop 86 is also inputted to the NAND gate 96. The output of the NAND gate 96 is sent through the Inverter 98 to the base of the transistor switch 100. The transistor switch 100 controls the turning on and turning off of the LED 102. When the transistor 100 is turned on, the LED 102 provides a red indication.

The outputs from the ninth sensor 28, the tenth sensor 30, and the eleventh sensor 32 are inputted to the NAND gate 106. The output of the NAND gate 106 communicates with the flip-flop 108, which includes the NAND gates 110, 112. The output of the NAND gate 112 is sent to the base of the transistor switch 114. The transistor switch 114 controls the turning on and turning off of the LED 116. When the transistor switch 114 is turned on, the LED 116 conducts and provides a green indication. The output of the NAND gate 110 of the flip-flop 108 is also applied to the NAND gate 118. The output of the NAND gate 118 is applied through the Inverter 120 to the base of the transistor switch 122, which controls the turning on and turning off of the LED 124. When the transistor switch 122 is turned on, the LED 124 conducts and provides a red indication.

OPERATION

The sensing, determining, and indicating of each of the predetermined failures associated with the present invention will now be discussed. When a failure of the solar fluid to circulate exists, the temperature of the collector is equal to or greater than a predetermined high temperature and the temperature of the tank is equal to or less than a predetermined temperature. In such a case, the first sensor or switch 12 opens indicating that the predetermined high temperature has been reached or exceeded and the sensor or switch 14 also opens indicating that the tank temperature is less than or equal to the predetermined temperature. With both switches 12, 14 open, both of the inputs to the NAND gate 44 are a logic HIGH. The output of the NAND gate 44 is then a logic LOW. This logic LOW is inputted to NAND gate 48 of flip-flop 46, which results in a logic LOW output from NAND gate 50 thereby turning off the transistor switch 52, and the green light indication provided by the LED 54 is no longer present. Conversely, the LED 62 of the indicator 36 conducts through the transistor switch 60, which has been turned on by the output of the Inverter 58. The output of the Inverter 58 is logic HIGH because of the logic HIGH being inputted to the NAND gate 56 from the NAND gate 48. Because the LED 62 conducts, a red light indication is provided indicating that a failure to circulate exists in the system.

When the collector temperature is less than the predetermined high temperature, or the tank temperature is greater than a predetermined temperature, or both, a logic HIGH is outputted by the NAND gate 44 because one or both inputs thereto are a logic LOW. This logic HIGH results in a logic HIGH output from NAND gate 50 thereby turning on the transistor switch 52 and causing the LED 54 to conduct. Conversely, the LED 62 is in its nonconducting state because the transistor switch 60 is turned off by the logic LOW outputted by the Inverter 58.

The predetermined fault identified as a failure of the system to shut down exists under different conditions, depending upon the type of solar system utilized. In the embodiment shown in FIG. 2, the present invention can be used with each of such systems with minor modifications to the hardware. In particular, for antifreeze systems and water draindown and recirculation systems, the shorting wire or jumper 126 located between the output of the fourth sensor 18 and the input to the NAND gate 64 is included or remains in place, while the jumper 128 located between the output of the Inverter 65 and the input to the NAND gate 64 is removed or opened. With these adaptations in place, the failure of the system to shut down exists when sunlight is not detected and, at the same time, the flow of solar fluid is detected. Specifically, when sunlight is not present, the third sensor or switch 16 is open causing a logic HIGH input to the NAND gate 64. When the flow of solar fluid is also detected, the fourth sensor or switch 18 opens thereby inputting a logic HIGH to the NAND gate 64. With both inputs to the NAND gate 64 being a logic HIGH, a logic LOW is outputted therefrom to NAND gate 68 of flip-flop 66. The output of the NAND gate 70 of the flip-flop 66 is also a logic LOW because of the logic LOW input to the flip-flop 66. The logic LOW output from NAND gate 70 causes the transistor switch 72 to turn off thereby preventing conduction through the LED 74 and extinguishing the green light indication provided by the LED 74. Conversely, the output of the NAND gate 68 of the flip-flop 66 is a logic HIGH resulting in a logic LOW output from the NAND gate 76. This output is inverted to a logic HIGH by the Inverter 78. The logic HIGH turns on the transistor switch 80 enabling the LED 82 to conduct through the transistor switch 80. The conducting of the LED 82 results in a red light indication that a failure of the solar fluid to circulate is present in the system.

When sunlight is present, and the third sensor or switch 16 is closed, or solar fluid is not flowing and the fourth sensor or switch 18 is open, or both, the output of the NAND gate 64 is a logic HIGH so the output of NAND gate 68 is LOW and the output of NAND gate 70 is HIGH so that the input to the transistor switch 72 is a logic HIGH enabling a green indication to be provided by the LED 74. Conversely, the logic HIGH output from the NAND gate 64 results in a logic LOW input to the NAND gate 76. This logic LOW input results in a logic LOW input to the transistor switch 80 preventing any conducting through the LED 82, and no red light indication results.

For drainback systems, in determining whether a failure to shut down is present, the jumpers 126 and 130 are removed and not used while the jumper 128 is used. The jumper 130 is located between two terminals of the fifth sensor or switch 20. Additionally, the fourth sensor or switch 18 is maintained in its open position. Consequently, in the drainback system, this predetermined fault occurs when the presence of water is detected and sunlight is not present. Specifically, when sunlight is not present, the third sensor or switch 16 is open causing a logic HIGH input to the NAND gate 64. When water is also present, the fifth sensor or switch 20 is closed thereby inputting a logic LOW to the Inverter 65. The Inverter 65 outputs a logic HIGH to the NAND gate 64. With both inputs to the NAND gate 64 being a logic HIGH, a logic LOW is outputted therefrom to NAND gate 68 of flip-flop 66. The output of NAND gate 70 of flip-flop 66 is also a logic LOW because of the logic input thereto. This logic NAND gate 70 of flip-flop 66 causes the transistor switch 72 to turn off thereby preventing conduction through the LED 74 and extinguishing the green light indication provided by the LED 74. Conversely, the output of the NAND gate 68 is a logic HIGH resulting in a logic LOW output from the NAND gate 76. This output is inverted to a logic HIGH by the Inverter 78. The logic HIGH turns on the transistor switch 80 enabling the LED 82 to conduct through the transistor 80. The conducting of the LED 82 results in a red light indication that a failure of night time circulation is present in the drainback system.

When sunlight is present so that the third sensor or switch 16 is closed and the fifth sensor 20 is open, the output of the NAND gate 64 is a logic HIGH so that the input to the transistor switch 72 is a logic HIGH enabling a green indication to be provided by the LED 74. Conversely, the logic HIGH output from the NAND gate 64 results in a logic LOW input to the NAND gate 76. This logic LOW input results in a logic LOW input to the transistor switch 80 preventing any conduction through the LED 82.

The predetermined fault identified as a failure of the system to be protected from freezing is also determined differently under the various solar systems. In the antifreeze system, the embodiment of FIG. 2 is modified by substituting the eighth sensor or switch 26 for the sixth sensor or switch 22, by removing the jumper 128, by including the jumpers 126 and 130, and by including the jumper 132 located between the sensor 26 and the NAND gate 84. With this configuration, when the eighth sensor or hydrometer switch 26 outputs a signal indicating that the specific gravity of the antifreeze is equal to or has decreased below a predetermined value, the hydrometer switch 26 is open and outputs a logic HIGH to the NAND gate 84. Because the jumper 130 results in a logic LOW input to the Inverter 65, a second logic HIGH is inputted to the NAND gate 84 from the Inverter 65. Since the inputs to the NAND gate 84 are both a logic HIGH, the output therefrom is a logic LOW. This logic LOW, through the flip-flop 86, results in a logic LOW input to the transistor switch 92 thereby turning off the transistor 92. Because the transistor 92 is turned off, the LED 94 cannot conduct and the green light provided thereby is extinguished. Conversely, the logic HIGH output from the NAND gate 88 results in a logic HIGH input to the NAND gate 96. This logic HIGH input results in a logic LOW input to Inverter 98 which results in a logic HIGH to the input to transistor switch 100 which turns it on and causes the LED 102 to conduct thereby providing a red indication that this failure exists.

When the hydrometer switch 26 is closed indicating a solar fluid specific gravity above a predetermined value, a logic LOW is inputted to the NAND gate 84 and a logic HIGH is outputted therefrom. As a result, a logic HIGH is inputted to the transistor switch 92 thereby enabling the LED 94 to conduct. In this state, the LED 94 provides a green indication that this predetermined fault is not present. Conversely, the logic HIGH output from the NAND gate 84 results in a logic LOW input to the NAND gate 96 and the transistor switch 100. This logic LOW input to the transistor switch 100 causes the LED 102 to be turned off indicating also that this failure does not presently exist in the system.

In conjunction with recirculation systems, the embodiment of FIG. 2 relating to the freeze protection fault is modified in that the jumper 130 is included so that a logic HIGH is always inputted from the Inverter 65 to the NAND gate 84. As with anitfreeze systems, jumper 126 is kept in place while jumper 128 is removed. This configuration is used because in a recirculation system water is continuously present in the pipe and collectors and need not be monitored. Additionally, the jumper 132 is removed so that the temperature of the pipe can be sensed.

In operation of the recirculation system therefore, when the sixth sensor or switch 22 is open indicating that the temperature of the collector is equal to or less than a predetermined temperature, or when the temperature of the pipe is less than or equal to a predetermined temperature, the respective switches 22, 24, or both, is opened thereby inputting a logic HIGH to the NAND gate 84. Similar to the operation of the logic in connection with the antifreeze system, the two logic HIGH inputs cause the LED 102 to conduct thereby providing a red indication, and further prevent conduction through the LED 94 thereby extinguishing the green light provided by the LED 94.

In water drainback and draindown systems, the failure of the system to be protected from freezing is monitored by using the outputs from the fifth sensor or switch 20, the sixth sensor or switch 22, and the seventh sensor or switch 24. With reference to the embodiment of FIG. 2, in such a case, the jumpers 126, 130, and 132 are removed while jumper 128 remains.

When water is detected as being present, the switch 20 is closed thereby resulting in a logic HIGH being inputted to the NAND gate 84, and when either the switch 22 is open because the collector temperature is equal to or less than a predetermined temperature, or the switch 24 is open because the pipe temperature is equal to or less than a predetermined temperature, the second input to the NAND gate 84 is also a logic HIGH. As with the antifreeze and recirculation systems, with both inputs to the NAND gate 84 being a logic HIGH, the LED 102 conducts thereby providing a red fault indication while the LED 94 is extinguished.

When water is not present, or the collector temperature is above the predetermined low temperature and the pipe temperature is above the predetermined low temperature, or both, both inputs to the NAND gate 84 are logic LOWs. Consequently, the output from the NAND gate 84 is a logic HIGH. This logic HIGH output results in a logic HIGH input to the transistor switch 92 thereby enabling the LED 94 to conduct. In this state, the LED 94 provides a green indication that this predetermined fault is not present. Conversely, the logic HIGH output from the NAND gate 84 results in a logic LOW input to the NAND gate 96 and the transistor switch 100. This logic LOW input to the transistor 100 causes the LED 102 to be turned off also indicating that this failure does not presently exist in the system.

The detection of the failure relating to a high tank temperature, a predetermined magnitude of corrosion being reached or exceeded, or a predetermined magnitude of scaling being reached or exceeded occurs or exists when a logic HIGH is inputted to the NAND gate 106. A logic HIGH is generated when the ninth sensor or switch 28 or the tenth sensor or switch 30 or the eleventh sensor or switch 32 opens as a result of sensing one or more of these predetermined conditions. In such a case, the output of the NAND gate 106 is a logic LOW resulting in a logic LOW output from NAND gate 112 of flip-flop 108. This logic LOW causes the transistor switch 114 to be turned off thereby extinguishing the green indication of the LED 116 because it is no longer in its conducting state. Conversely, the logic LOW output from the NAND gate 106 results in a logic HIGH input to the NAND gate 118. As a result, a logic LOW is outputted from the NAND gate 118 and a logic HIGH is outputted from the Inverter 120. This logic HIGH turns on the transistor switch 122 enabling the LED 124 to conduct and provide a red indication. This red light indicates that one of the three aforesaid predetermined conditions is present thereby resulting in the existence of the predetermined failure.

When the tank temperature is below the predetermined high temperature, and the predetermined magnitude of corrosion and scaling have not been reached or exceeded, a logic LOW is inputted to the NAND gate 106 resulting in a logic HIGH output therefrom. This logic HIGH causes a logic HIGH to be outputted by NAND gate 112 of flip-flop 108. This logic HIGH, in turn, causes the transistor switch 114 to be turned on providing a conducting path for the LED 116. As a result, a green light indication is provided indicating that this predetermined failure is not present. Conversely, the logic HIGH output from the NAND gate 106 results in a logic HIGH output from the NAND gate 118 so that a logic LOW is inputted to the transistor switch 122. Because of the logic LOW input, the transistor switch 122 is maintained in its off condition, and the LED 124 is in its nonconducting state.

In a preferred embodiment, a timing circuit 134 is also provided. The output of the timing circuit 134 is inputted to each of the NAND gates 56, 76, 96, 118. The timing circuit 134 is included so that, when one or more predetermined faults or failures occur, the appropriate LED 62, 82, 102, 124 gives a red flashing signal. The flashing signal is achieved because the output of the timing circuit 134 continuously alternates between a logic LOW and a logic HIGH. Consequently, during the time the output of the timing circuit 134 is a logic HIGH, and a predetermined fault exists, the appropriate LEDS 62, 82, 102, 124 will conduct.

Additionally, in the embodiment of FIG. 2, a reset switch 136 is electrically connected to NAND gates 50, 70, 90, 112. When the reset switch 136 is activated or closed, each of the LEDs 54, 74, 94, 116 conducts to provide a green light indication. When the reset switch 136 is then released or opened, unless a predetermined fault or failure is present in the system, the LEDs 54, 74, 94, 116 maintain their conducting state providing a green light indication.

From this it is understood that the flip-flops 46, 66, 86, 108 act to maintain a flashing red light fault indication after the fault is no longer present so that the user is made aware that the fault occurred, and in the case in which the fault no longer exists, a manual resetting using reset switch 136 results in the termination of the flashing red and the providing of a green indication.

In addition, in the embodiment of FIG. 2, test switches 131, 138, 140 are included for testing the operation of the logic circuit 34 and the indicators 36–42. These latter switches enable the user to apply a logic HIGH to each of the inputs to the NAND gates 44, 64, 84, 106. When the test switches 131, 138, 140 are positioned to provide logic HIGHs to each of the inputs to the NAND gates 44, 64, 84, 106, the LEDs 62, 82, 102, 124, associated with providing a flashing red fault indication, should periodically conduct if the system is operating properly. Conversely, the LEDs 54, 74, 94, 116 should not conduct and be extinguished, if the system is operating properly.

From the foregoing, it should be understood that although the embodiment of FIG. 2 can be adapted to function with each type of active solar system, an embodiment can be provided for use with only one of the aforementioned solar systems. For example, to detect predetermined failures in an antifreeze system, fifth sensor 20, sixth sensor 22, and seventh sensor 24 would not be included. Additionally, Inverter 65, together with the electrical connection from the output thereof to the NAND gate 64, would not be provided.

Having described the invention with particular reference to certain embodiments thereof, it will be obvious that various changes and modifications may be made therein without parting from the spirit and scope of the invention, as defined in the appended claims.

The embodiments of the invention in which an exclusive property or privilege is claimed are defined as follows:

1. An apparatus for detecting predetermined faults in a variety of active, different solar systems, each of said different solar systems using a heat transfer fluid and having a tank for receiving fluid or a heat exchanger to transfer heat from the heat transfer fluid to a tank, and at least one collector and one pipe through which fluid flows, said different solar systems each having different predetermined operating conditions associated with a given type of fault, comprising:

a. a plurality of sensing means for sensing the presence of different predetermined operating conditions associated with each of the solar systems, each of said sensing means including a switch that changes in state in response to a change in a predetermined operating condition in at least one of said fluid, tank or heat exchanger, collector, and pipe;

b. means in communication with each of said sensing means for determining whether one or more predetermined faults have occurred in one of said solar systems, said means for determining including combining means, said combining means including logic gates at least one of which is actuated by logic gate actuating voltages via the associated states of at least two of said switches to produce an output signal indicative of whether a predetermined fault is present in the one solar system; and c. indicating means responsive to said output signal for indicating the presence and identity of said one predetermined fault in said one solar system.

2. An apparatus, as claimed in claim 1, wherein:
said plurality of sensing means includes a first sensing means for sensing the temperature of the collector, and a second sensing means for sensing the temperature of the tank, and said combining means being responsive to the outputs of said first sensing means and said second sensing means, at the same time, for determining whether the temperature of the collector is greater than a predetermined temperature and whether the temperature of the tank is less than a predetermined temperature to determine whether a failure to circulate fluid is present in the system.

3. An apparatus, as claimed in claim 1, wherein:
said plurality of sensing means includes a third sensing means for sensing the presence of sunlight and a fourth sensing means for sensing the flow of fluid in the collector or pipe, and said combining means being responsive to the outputs of said third sensing means and said fourth sensing means, at the same time, to determine whether a failure to shut down is present in the system.

4. An apparatus, as claimed in claim 1, wherein:
said plurality of sensing means includes third sensing means for sensing the presence of sunlight and a fifth sensing means for sensing the presence of fluid in the collector or pipe, and said combining means being responsive to the outputs of said third sensing means and said fifth sensing means, at the same time, to determine whether a failure to shut down is present in the system.

5. An apparatus, as claimed in claim 1, wherein:
said plurality of sensing means includes fifth sensing means for sensing the presence of fluid in the collector or pipe, sixth sensing means for sensing the temperature of the collector, and seventh sensing means for sensing the temperature of the pipe, and said combining means being responsive to the outputs of said fifth sensing means, said sixth sensing means, and said seventh sensing means, at the same time, to determine whether a failure to protect the system from freezing is present.

6. An apparatus, as claimed in claim 1, wherein:
said plurality of sensing means includes a sixth sensing means for sensing the temperature of the collector or a seventh temperature sensing means for sensing the temperature of the pipe.

7. An apparatus, as claimed in claim 1, wherein:
said plurality of sensing means includes an eighth sensing means for sensing the specific gravity of the solar fluid.

8. An apparatus, as claimed in claim 1, wherein:
said plurality of sensing means includes ninth sensing means for sensing whether the temperature of the tank is equal to or greater than a predetermined temperature to determine whether a failure to protect the system from overheating is present.

9. An apparatus, as claimed in claim 1, wherein:
said plurality of sensing means includes tenth sensing means for sensing whether at least a predetermined amount of scaling is present in the pipe to determine whether a failure due to excessive scaling is present in the system.

10. An apparatus, as claimed in claim 1, wherein:
said plurality of sensing means includes eleventh sensing means for sensing whether at least a predetermined amount of corrosion is present in the pipe to determine whether a failure due to excessive corrosion is present in the system.

11. An apparatus, as claimed in claim 1, wherein:
said plurality of sensing means includes ninth sensing means for sensing whether the temperature of the tank is equal to or greater than a predetermined temperature, tenth sensing means for sensing whether at least a predetermined amount of scaling is present in the pipe, and eleventh sensing means for sensing whether at least a predetermined amount of corrosion is present in the pipe, and said combining means being responsive to said ninth sensing means, said tenth sensing means, and said eleventh sensing means, for determining whether a failure to protect the system for overheating is present, or whether a failure due to excessive scaling is present in the system, or whether a failure due to excessive corrosion is present in the system.

12. An apparatus, as claimed in claim 1, wherein:
said indicating means includes means for indicating that said one predetermined fault is not present in said one solar system.

13. An apparatus, as claimed in claim 1, wherein:
said combining means includes a NAND gate.

14. An apparatus, as claimed in claim 1, wherein:
the presence of one of said predetermined faults is determined separately from the determination of the presence of each of said other predetermined faults, and an indication is separately provided for identifying each of said predetermined faults.

15. An apparatus, as claimed in claim 1, wherein:
said means for determining includes means for maintaining an indication that a predetermined fault occurred, even after said predetermined fault is no longer present.

16. An apparatus, as claimed in claim 15, wherein:
said means for determining includes reset means for removing said predetermined fault indication.

17. An apparatus, as claimed in claim 1, further including:
testing means for testing the operation of said indicating means to determine whether said indicating means provides an indication of the presence of a predetermined fault.

18. A method for detecting the presence of predetermined faults in a variety of active, different solar systems, each of said different solar systems using a heat transfer fluid and having a tank for receiving fluid or a heat exchanger to transfer heat from the heat transfer fluid to a tank, and at least one collector, and at least one pipe, said different solar systems each having different predetermined operating conditions associated with a given type of fault, said method comprising:

a. sensing whether a plurality of different predetermined operating conditions associated with the operation of one solar system are present using switches that change in state in response to a change in a predetermined operating condition of at least one of said fluid, tank or heat exchanger, collector, and pipe;

b. combining at least two of the different predetermined sensed operating conditions of said one solar system to produce an output signal indicative of whether a predetermined fault has occurred in said one solar system based on the combining of said two of the predetermined sensed operating conditions using logic gates at least one of which is actuated by logic gate actuating voltages via the associated states of at least two of said switches to produce said output signal; and c. indicating in response to the output signal the presence and identity of said one predetermined fault in said one solar system.

19. A method, as claimed in claim 18, wherein:
said sensing step includes the sensing of the temperature of the collector and the temperature of the tank.

20. A method, as claimed in claim 19, wherein:
said combining step includes combining a signal relating to the temperature of the collector with a signal relating to the temperature of the tank to determine whether a failure to circulate solar fluid is present in the system.

21. A method, as claimed in claim 18, wherein:
said sensing step includes sensing whether sunlight is present and sensing whether fluid is present in the collector or pipe.

22. A method, as claimed in claim 21, wherein:
said combining step includes combining a signal relating to whether sunlight is present with a signal relating to whether fluid is present in the collector or pipe to determine whether a failure to shut down the system is present.

23. A method, as claimed in claim 18, wherein:
said sensing step includes sensing whether sunlight is present and sensing whether solar fluid is flowing in the collector or pipe.

24. A method, as claimed in claim 23, wherein:
said combining step includes combining a signal relating to whether sunlight is present with a signal relating to whether solar fluid is flowing in the collector or pipe to determine whether a failure to shut down the system is present.

25. A method, as claimed in claim 18, wherein:
said sensing step includes the steps of sensing the presence of solar fluid in the collector or pipe, sensing the temperature of the pipe, and sensing the temperature of the collector.

26. A method, as claimed in claim 25, wherein:
said combining step includes combining a signal relating to whether solar fluid is present in the collector or pipe with a signal relating to the temperature of the pipe to determine whether a failure to protect the system from freezing is present.

27. A method, as claimed in claim 25, wherein:
said combining step includes combining a signal relating to whether solar fluid is present in the collector or the pipe with a signal relating to the temperature of the collector to determine whether a failure to protect the system from freezing is present.

28. A method, as claimed in claim 18, wherein:
said sensing step includes the step of sensing the specific gravity of the fluid.

29. A method, as claimed in claim 18, wherein:
said sensing step includes the sensing of whether a predetermined amount of scaling is present in the system.

30. A method, as claimed in claim 18, wherein:
said sensing step includes the sensing of whether a predetermined amount of corrosion is present in the system.

31. A method, as claimed in claim 18, wherein:
said indicating step includes providing an indication that a predetermined fault is not present in the system when said predetermined fault is not present.

* * * * *